US005632880A

United States Patent [19]

Santini

[11] Patent Number: 5,632,880

[45] Date of Patent: May 27, 1997

[54] PROCESS FOR GALVANIC CHROMIUM PLATING

[76] Inventor: Marco Santini, Severin-Kern-Strasse 44, D-78052 Villingen-Schwenningen, Germany

[21] Appl. No.: 694,738

[22] Filed: Aug. 9, 1996

[30] Foreign Application Priority Data

Aug. 12, 1995 [DE] Germany ..... 195 29 843.8

[51] Int. Cl.[6] ..... C25D 5/34

[52] U.S. Cl. ..... 205/210; 205/219; 205/243; 205/285; 205/287; 205/483; 205/484

[58] Field of Search ..... 205/210, 219, 205/243, 285, 287, 483, 484

[56] References Cited

U.S. PATENT DOCUMENTS

| | | | |
|---|---|---|---|
| 3,615,741 | 10/1971 | Gilchrist | 106/14 |
| 3,951,759 | 4/1976 | Studer | 204/32 R |
| 4,039,399 | 8/1977 | Wallace et al. | 204/25 |
| 4,056,339 | 11/1977 | Doi | 418/178 |
| 4,417,955 | 11/1983 | Barclay et al. | 204/43 R |
| 4,846,940 | 7/1989 | Neuhäuser et al. | 204/16 |
| 4,894,125 | 1/1990 | Fenolia et al. | 204/33 |
| 5,137,619 | 8/1992 | Moriki et al. | 205/179 |

FOREIGN PATENT DOCUMENTS

| | | | |
|---|---|---|---|
| 2502284C2 | 10/1986 | Germany | C25D 3/10 |
| 3531410C2 | 3/1989 | Germany | C25D 15/00 |
| 3813617C1 | 10/1989 | Germany | C25D 5/48 |
| 4011201C1 | 8/1991 | Germany | C25D 5/18 |
| 4116686A1 | 12/1991 | Germany | C25D 5/10 |

*Primary Examiner*—Benjamin Utech

*Attorney, Agent, or Firm*—Panitch Schwarze Jacobs & Nadel, P.C.

[57] ABSTRACT

A process for galvanic deposition of chromium coatings is provided in which the base material is subjected to a galvanic chromium plating bath to form a hard chromium coating with beaded or columnar type surface structure, and the beaded or columnar type surface structure is subsequently filled and smoothed with galvanically applied black chromium. The resulting combined coatings yield increased wear resistance, lower friction values, even without lubricants, and increased corrosion resistance.

12 Claims, 1 Drawing Sheet

PROCESS FOR GALVANIC CHROMIUM PLATING

FIELD OF THE INVENTION

The invention concerns a process for galvanic deposition of chromium coatings on an electrically conducting, especially metallic, base material, wherein the base material is first cleaned and activated, and then exposed to a galvanic chromium plating bath for formation of a hard chromium coating with hardness of at least 600 HV with a beaded or columnar type surface structure.

BACKGROUND OF THE INVENTION

A chromium-plating bath of this type is described in German patent 25 02 284, in which glossy to metal-gray chromium coatings with a beaded type surface structure having a hardness up to approximately 1,500 HV may be obtained. These chromium coatings with the trademark "DURALLOY" are distinguished first by a high resistance to wear and second by favorable antifriction properties, since the homogeneous globular surface favors wettability and therewith the formation of a stable oil film.

SUMMARY OF THE INVENTION

Underlying the present invention is the objective of further improving the known chromium coating such that it has high resistance to wear along with low friction values even without lubricants. This objective is accomplished according to the present invention in that the beaded or columnar type surface structure of the hard chromium coating is filled and smoothed by galvanically applied black chromium. This black chromium is applied in a coating thickness of at least 1 μ, preferably from approximately 2 μ to about 6 μ, whereby it is assured that the beaded or columnar structure of the underlying hard chromium layer is wholly or largely covered. In so far as the black chromium projects above the underlying hard chromium layer, it is compressed within a short time according to use and load in practical operation by a sort of running-in process, and consequently embedded in the homogeneous beaded structure.

It has been surprisingly demonstrated that with this mixed structure, additional lubricants can be completely dispensed with, and that one nevertheless obtains a threefold to sixfold extension of the running time of the member coated in accordance with the invention. In connection with this, the application range extends over temperatures from minus 150° C. to plus 500° C. This result is above all astonishing, because a black chromium coating on a hard chromium coating appears to make little sense. Black chromium coatings are essentially used only for decorative reasons in entertainment electronics and the clock industry and, as is well known on account of their high oxygen content, have a poor mechanical stability, and particularly little resistance to abrasion. They therefore appeared until now to be largely unsuited for technical applications.

It is indeed already known to improve the tribological properties of hard chromium coatings by embedding PTFE therein. For this, the hard chromium layer is subjected to chemical aftertreatment such that inhomogeneities arise on the surface, which are subsequently extended by heating. PTFE in the form of a powder is then pressed into these inhomogeneities. To be sure, one can derive no suggestions from this known procedure for applying instead an additional coating of black chromium.

In order to guarantee good adhesion of the black chromium coating on the hard chromium base, interposing some rinsing processes is recommended, so that no electrolyte fluid from the hard chromium bath is spread into the black chromium bath. The two galvanic baths should likewise follow upon one another within 3–5 minutes, so that no oxide layer forms on the hard chromium. Otherwise, this must be removed before dipping into the black chromium bath.

For obtaining an optimal surface structure, it is recommended that the beaded or columnar type surface of the hard chromium layer have a distance between the centers of neighboring elevations of about 1 μ to approximately 5 μ. This can be reliably controlled by adhering to the parameters described for the chromium-plating bath in German patent 25 02 284, the disclosure of which is incorporated by reference.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF PREFERRED EMBODIMENTS

Figure 1:
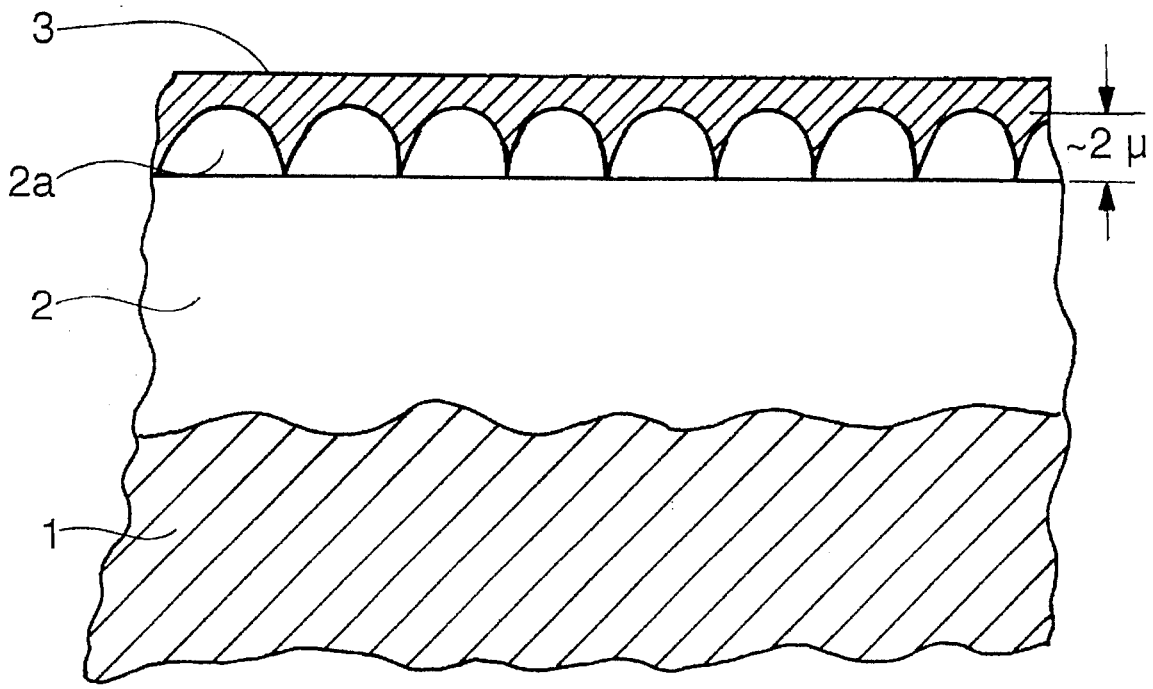
FIG. 1 is a cross section through the workpiece following application of the hard chromium and black chromium layer according to the present invention.

The process proceeds from a metallic workpiece which is first degreased, thermally at a maximum of 70° C. and electrolytically, and then converted from the basic to the acid state by means of a 5% sulfuric acid solution, in order to activate it for the subsequent galvanic treatment. The workpiece is then dipped in a chromium-plating bath which contains 400 to 500 g/l of chromium trioxide, 2 to 14 g/l strontium sulfate, 4 to 26 g/l potassium fluorosilicate 2 to 8 g/l potassium dichromate, and 4 to 50 g/l technical 2,2-dicloromalonic acid. Reference is made to the already mentioned German patent 25 02 284 with respect to the remaining treatment parameters.

The workpiece 1 (see FIGS. 1 and 2) thereby receives a hard chromium coating 2 with a layer thickness of at least 2 μ, preferably about 4–6 μ or more. The bath parameters are so adjusted that a more or less regular beaded structure 2*a* is achieved with a peak-to-valley height of at least 1 μ, preferably approximately 1.5 μ to about 5 μ appears.

After this processing the workpiece is rinsed in order to remove the chromium-plating bath residue, and then dipped in a second galvanic bath in order to apply a black chromium layer to the beaded structure. The black chromium baths marketed under the trade marks ANKOR 1130 and 1131, among others, are suitable as black chromium electrolytes. They contain about 420 to 480 g/l of chromic acid, about 2 to 15 g/l of chromic oxide, $Cr_2O_3$, and are preferably free of sulfate. The bath temperature may be at room temperatures and the current density at 15 to 30 A/dm$^2$.

Figure 2:
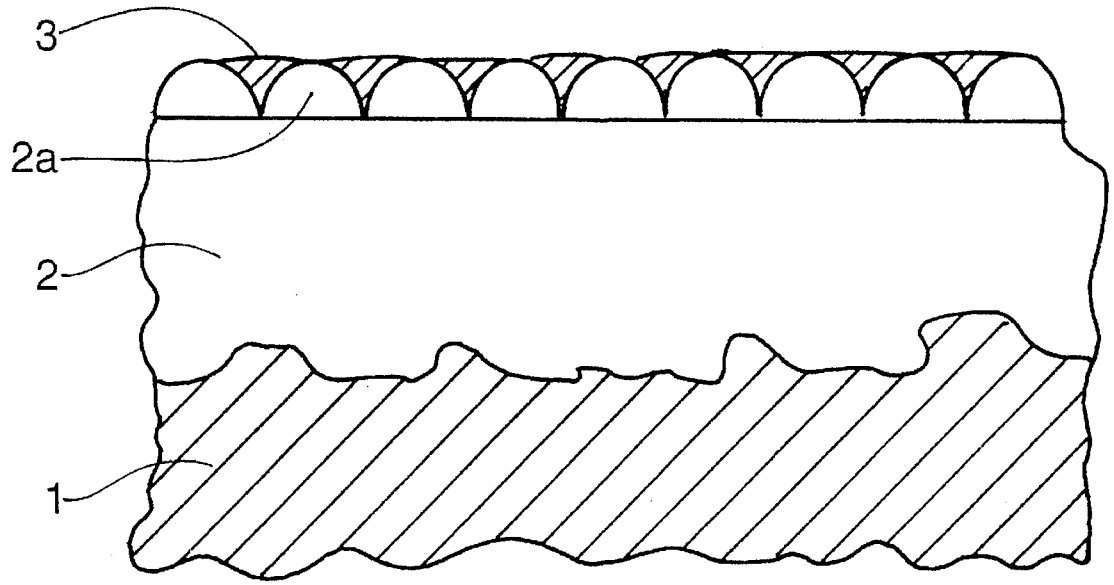
FIG. 2 is the same cross section following running in of the workpiece.

After a few minutes' treatment time, one obtains a hard chromium layer of about 2 μ to about 5 μ containing about 93% to about 96% chromium and about 4% to about 7% chromium oxide. The thickness of the layer is possibly so chosen that the beaded structure 2*a* of the hard chromium layer is at least filled and evened, and preferably also receives a certain overcovering, as shown in FIG. 1. This overcovering is worn off after a short running-in time due to the low abrasion resistance of black chromium and is compacted into the bead structure, whereupon the surface structure depicted in FIG. 2 arises. It is characterized by a coherent black chromium phase, which is penetrated by a plurality of hard chromium islands. It has neither pores nor cracks.

For stabilizing the black chromium layer, especially for binding the chromium mixed oxide, it can be sealed by means of a polishing emulsion.

Studies have shown that the surface structure described has extraordinarily high resistance to wear along with low friction values and can also be used in areas without lubrication. Thus, the test of a guide rail with a car running on it yielded a traversed stretch of 12 km for uncoated rollers or rollers with a ZnFe coating, but 65 km for rollers with a coating of the present invention. In the case of the uncoated rolling surfaces, this led to a breakdown.

At the same time, there exists a high corrosion protection: In a salt spray test according to DIN 50021 SS, the useful life of a workpiece coated in accordance with the present invention was established at 400 hours, in contrast to a useful life of 24 hours for a normal workpiece coated with 20–25 μ hard chromium plating, and in comparison with a useful life of 120 hours for a 2–4 μ DURALLOY hard chromium-plated workpiece.

In sum, the invention distinguishes itself by considerably extended service lives, low friction values and through savings in lubricants.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A process for galvanic deposition chromium coatings on a metallic base material, comprising cleaning the base material, exposing the cleaned base material to a galvanic chromium-plating bath to form a hard chromium coating having a hardness of at least 600 HV with beaded surface structure, and galvanically applying a black chromium coating on the hard chromium coating to fill and smooth the beaded surface structure.

2. The process according to claim 1, wherein the cleaning of the base material includes degreasing.

3. The process according to claim 1, wherein the cleaning of the base material is followed by activation of the base material with an acid.

4. The process according to claim 1, wherein the black chromium is applied in a layer thickness of at least 1 μ.

5. The process according to claim 4, wherein the black chromium is applied in a layer thickness of about 2 μ to about 6 μ.

6. The process according to claim 1, wherein the black chromium contains chromic oxide.

7. The process according to claim 6, wherein the black chromium contains about 93% to approximately 96% chromium and about 4% to about 7% chromic oxide.

8. The process according to claim 1, further comprising at least one rinsing step between the galvanic hard chromium plating and the galvanic black chromium plating.

9. The process according to claim 1, wherein the galvanic black chromium plating takes place within about three to five minutes after the hard chromium plating has occurred.

10. The process according to claim 1, wherein any oxide layer formed on the hard chromium layer is removed before the black chromium plating.

11. The process according to claim 1, wherein the black chromium layer is sealed by an emulsion.

12. The process according to claim 1, wherein the beaded surface structure of the hard chromium layer has a distance between centers of neighboring elevations of about 1 μ to about 5 μ.

* * * * *